United States Patent [19]

Mains

[11] Patent Number: 4,867,332

[45] Date of Patent: Sep. 19, 1989

[54] TOOL HOLDER

[76] Inventor: Gregory T. Mains, 11370 Trade Center Dr., Suite 1, Rancho Cordova, Calif. 95740

[21] Appl. No.: 258,823

[22] Filed: Oct. 17, 1988

[51] Int. Cl.[4] ..... B65D 6/40

[52] U.S. Cl. ..... 220/85 H; 220/23.83; 220/85 R; 206/372; 206/373; 206/376

[58] Field of Search ..... 206/1.7, 15.2, 15.3, 206/315.3, 361, 372, 373, 376, 377, 378, 558; 220/20, 23.83, 85 R, 85 H, 90; 224/918

[56] References Cited

U.S. PATENT DOCUMENTS

| | | | |
|---|---|---|---|
| 323,420 | 8/1885 | Hills | 220/90 |
| 1,125,585 | 1/1915 | Menger | 220/85 R |
| 1,249,439 | 12/1917 | McCoy . | |
| 1,254,714 | 1/1918 | McCombs | 220/90 |
| 1,682,571 | 8/1928 | Horan | 220/90 |
| 1,739,793 | 12/1929 | Hardt . | |
| 2,436,924 | 3/1948 | Hansen | 220/90 |
| 2,565,912 | 8/1951 | Davis | 206/1.7 |
| 3,014,595 | 12/1961 | Bartmann | 224/918 |
| 3,298,532 | 1/1967 | Wilcke . | |
| 3,301,459 | 1/1967 | Gardner | 220/90 |
| 3,442,435 | 5/1969 | Ludder et al. | 220/20 |
| 3,819,080 | 6/1974 | Bird | 220/20 |
| 4,024,590 | 5/1977 | Wendt | 220/23.83 |
| 4,100,652 | 7/1978 | Carlson | 206/315.3 |
| 4,145,789 | 3/1979 | Morgan, Sr. | 220/90 |
| 4,356,916 | 11/1982 | Anglemyer . | |
| 4,362,243 | 12/1982 | Deyesso et al. . | |
| 4,768,652 | 9/1988 | Fallon | 206/373 |

*Primary Examiner*—David T. Fidei

*Attorney, Agent, or Firm*—Flehr, Hohbach, Test, Albritton & Herbert

[57] ABSTRACT

A tool holder is disclosed which holds tools, implements, equipment and other such objects within a container such as a five-gallon bucket. The tool holder is characterized in having an upstanding annular wall which extends along a partial sector of a circle and which carries at its lower end a radially inwardly projecting horizontal ledge. An outwardly and downwardly extending lip is formed about the upper circumference of the annular wall for releasable engagement with the upper rim of the bucket. With the lip engaged on the bucket rim the ledge is supported within the bucket. In certain embodiments openings are formed through the ledge for receiving and supporting the tools and implements. In another embodiment radially extending side walls and an inner wall cooperate with the annular wall and ledge to form a box-shaped container for holding the tools and implements.

9 Claims, 3 Drawing Sheets

TOOL HOLDER

BACKGROUND OF THE INVENTION

This invention relates to devices by which tools and other implements can be organized and carried within containers of the five gallon bucket type.

Holder devices have previously been provided for use in carrying tools, implements, sporting equipment and the like in containers of the five gallon bucket type. Such buckets are readily available and are of a size which makes it convenient to carry and store a variety of tools, implements and other equipment.

Among the tool holders previously suggested is that shown in U.S. Pat. No. 4,362,243 issued to Deyesso et al. The device of the Deyesso patent comprises a circular ring which is snugly fit within the inner diameter of the bucket. Openings or flutes are formed about the ring for supporting the tools. Among the drawbacks and limitations of such a tool holder is that it can only fit with a relatively narrow range of bucket sizes. Separate spacers must be installed for fitting the ring into buckets which are oversize. Another disadvantage with the tool holder of the Deyesso patent is that fasteners must be used to fixedly attach the ring to the bucket wall with the result that it is more difficult to mount and dismount the holder.

It is accordingly an object of the present invention to provide a tool holder of the type described which obviates many of the disadvantages and limitations of prior art tool holders.

It is another object of the present invention to provide a tool holder of the type described which permits a single holder to be universally used with containers of a wider range of diameters without the use of separate adapters or spacers.

Another object is to provide a tool holder of the type described which is easily mounted and firmly secured to a bucket without the requirement of fasteners, and which can be rapidly dismounted as required.

Another object is to provide a tool holder of the type described comprised of a plurality of separate module units of varying size and configuration by which different modules can be mounted together in combination within a bucket for carrying a variety of tools, implements and other equipment.

SUMMARY OF THE INVENTION

The invention in summary comprises a tool holder having an upstanding annular wall which is C-shaped and extends along a partial sector of a circle. Carried at the lower end of the annular wall is an inwardly projecting horizontal ledge which is adapted for supporting the tools, implements and other equipment. Means is provided at the upper end of the annular wall for releasably mounting the holder to the upper rim of the bucket. In one embodiment one or more openings are formed through the ledge for insertion of the tools or implements. In another embodiment radial side walls and an inner wall are provided in combination with the annular wall and ledge to form a box-shaped modular holder for the tools and implements.

The foregoing and other objects and features of the invention will appear from the following specification in which the several embodiments have been set forth in conjunction with the accompanying drawings.

DESCRIPTION OF THE PREFERRED EMBODIMENT

Figure 1:
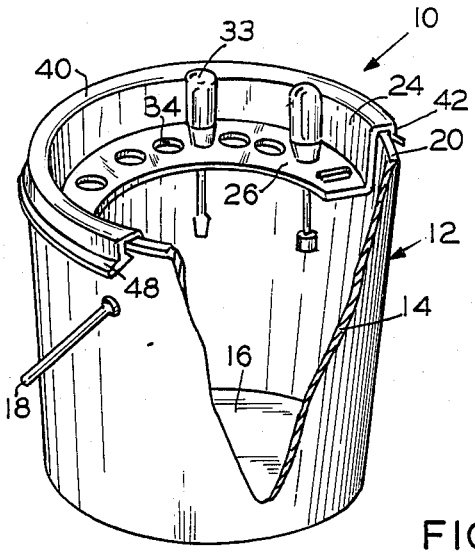
FIG. 1 is a partially cut-away perspective view of the tool holder of one embodiment shown mounted on a typical bucket.
Figure 2:
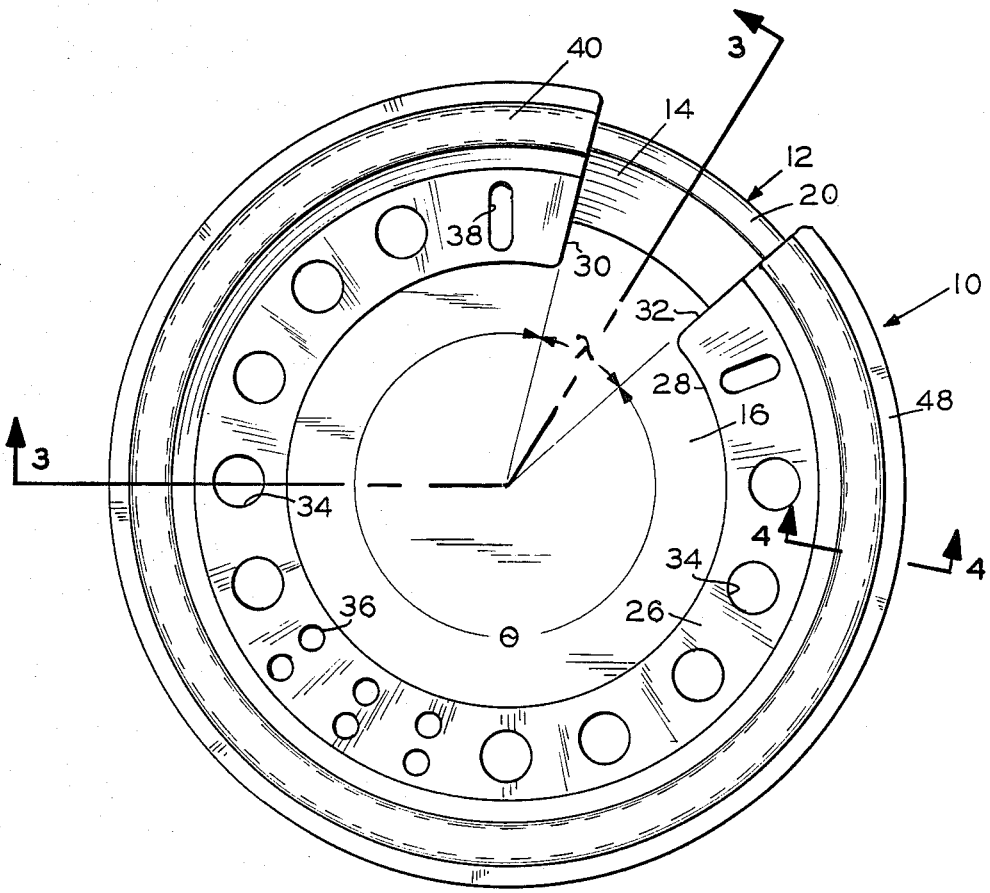
FIG. 2 is a top plan view to an enlarged scale of the tool holder of FIG. 1.
Figure 3:
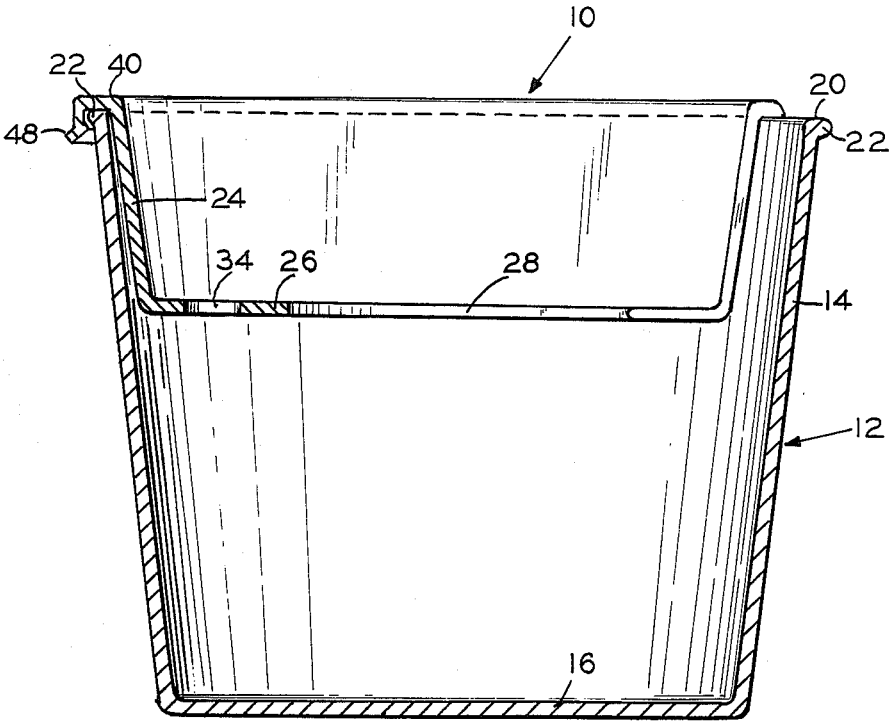
FIG. 3 is a cross-sectional view taken along the line 3—3 of FIG. 2.

In the drawings FIGS. 1–4 illustrate one preferred embodiment of the invention providing a tool holder 10 for use with an open-ended container or can, which is shown as a typical five gallon bucket 12. Bucket 12 is comprised of an outer wall 14 closed at its lower end by bottom wall 16. A carrying handle or bail 18 is attached at opposite sides of the outer wall. The outer wall of the bucket typically is frusto-conical tapering from its large diameter upper end to a smaller diameter at the bottom. The container or bucket could also be cylindrical shaped with a uniform circular cross-section. As used herein the phrase cylindrical wall encompasses an outer wall of frusto-conical shape as well as a cylindrical shape with uniform cross-section. The upper rim 20 of wall 14 has an outwardly projecting reinforcing bead 22.

Tool holder 10 is comprised of an upstanding annular wall 24 having an outer diameter substantially commensurate with the inner surface of the bucket wall along the margin adjacent rim 20. Preferably the side-profile shape of annular wall 24 conforms with the side-profile shape of bucket wall 12, and in this embodiment annular wall 24 has a frusto-conical taper generally conforming to the taper of the bucket wall. The standard size five gallon bucket which is generally available typically has an inner diameter of 11" at its upper rim.

A horizontal ledge 26 is formed integral with and projects radially inwardly from the lower end of annular wall 24 on the tool holder. The ledge extends inwardly at a width which is between one-fifth and one-half of the radius of the cylindrical wall at the plane of the ledge. In the illustrated embodiment where the radius of the bucket wall at the plane of ledge is on the order of 10¾" the width of ledge is within the range of 1" to 2.5"and preferably 1.5". This dimensioning of the ledge width provides a circular opening 28 through which tools, implements and the like may be placed down into the bottom of the bucket, or withdrawn from the bucket, as desired.

The partial sector along which the annular wall extends forms a gap between the opposite ends 30 and 32 of the wall and ledge. The angle Θ circumscribed by the wall and ledge of the tool holder in the embodiment of FIGS. 1–4 is 325° such that the angle of the gap is 35°. The magnitude of the angle Θ, and thereby the size of the tool holder, is predetermined in accordance with the requirements of a particular application. Where the requirements call for holding only a relatively smaller number of tools then the size of the tool holder and the sector angle Θ can be smaller than the 325° angle illustrated in FIG. 2.

One or more openings 34, 36 and 38 are formed in spaced relationship about the ledge with each of the openings sized and proportioned for holding different types of tools, implements or other equipment. For a typical application of the holder for use by a carpenter or mechanic, the holes can be circular varying between 1⅛", ⅜" and 5/16" diameters. These circular holes are adapted to fit the shanks or handles of such tools as the screwdrivers 33, pliers or braces and the like. The openings can be of other configurations, such as the elongate openings 38 which are suitable to fit with the handles of wrenches or pliers.

Figure 4:
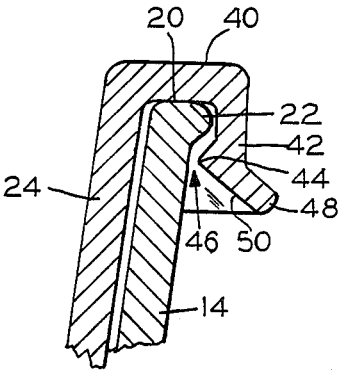
FIG. 4 is a partial cross-sectional view to an enlarged scale taken along the line 4—4 of FIG. 2.

Means for releasably mounting tool holder 10 to the upper rim of the bucket is provided and includes a lip 40 which is formed integral with and extends circumferentially about the upper end of annular wall 24. As best shown in FIG. 4 the lip 40 has a downwardly extending portion 42 which is formed at its inner end with an intrusive ridge 44. This ridge is spaced from the outer surface of annular wall 24 to define a channel 46. Preferably the width of channel 46 is marginally less than the radial width of upper rim 20 on the bucket. The lip further includes a downwardly and outwardly directed portion 48 which provides an inclined camming surface 50.

Tool holder 10 is formed of a suitable plastics material having elastomeric properties, such as polyvinyl chloride. The tool holder is mounted onto the bucket by manually pushing lip 40 downwardly so that the camming action of inclined surface 50 causes ridge 46 to be forced outwardly and over the surface of bead 22 until it snaps back by the action of elastic memory to the position illustrated in FIG. 4. At this position the ridge captures the upper rim of the bucket within the channel 46 formed by the lip. This functions to releasably secure the tool holder to the bucket. When it is desired to dismount the tool holder, upward pressure is applied manually against the lip to spread inclined portion 48 outwardly. This opens the width of channel 46 and permits the lip to be raised clear of the bucket rim.

The resilient properties of the elastomeric material of tool holder 10 permit it to be mounted onto containers and buckets of diameters which may vary from the nominal diameters of typical five gallon buckets. Where the buckets may have oversize diameters the tool holder can be manually spread open by flexing to a larger diameter sufficient to accommodate the upper rim of the particular bucket. Similarly, where the bucket may be undersized the tool holder ends 30, 32 can be forced together, to the extent permitted by the size of the gap, sufficient to accommodate the smaller diameter bucket rim.

FIGS. 5–8 illustrate another embodiment of the invention which provides a tool holder 52 comprised of modular holder units 54, 56 and 58 each of which is adapted for supporting a variety of different tools, implements or other equipment. In this embodiment the user can combine one or more of the modular units for mounting in a single bucket 59 to hold specialized tools or implements that may be required for a particular job.

Figure 6:
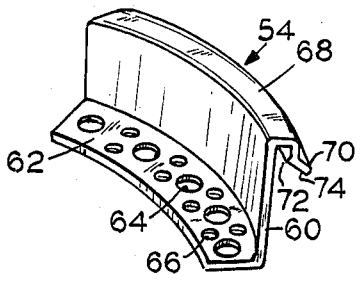
FIG. 6 is a perspective view illustrating one of the modular units of FIG. 5.

Modular unit 54 of this embodiment is similar in construction to the tool holder for the embodiment of FIGS. 1–4 but encompasses a smaller partial sector angle $\phi$, shown as 85°. As illustrated in FIG. 6 modular unit 54 is comprised of an annular wall 60 which mounts at its lower end a horizontally projecting ledge 62. The ledge is formed with a plurality of spaced apart openings 64, 66. Unit 54 is mounted within the bucket by means of an outwardly projecting lip 68 which is formed integral with the upper end of wall 60. Lip 68 has a downwardly projecting portion 70, intrusive ridge 72 and cam surface 74 which releasably mount over the bucket rim 76 in the manner explained above for the embodiment of FIGS. 1–4.

Figure 7:
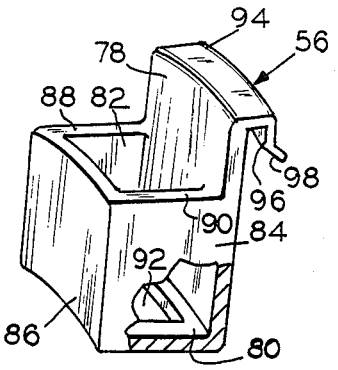
FIG. 7 is a partially broken away perspective view of another modular unit of FIG. 5.

Another modular unit 56 of this embodiment, which is illustrated in detail in FIG. 7, is comprised of an annular wall 78 which extends along a relatively small partial sector angle $\beta$, shown as 35°.

Modular unit 56 is in a box-shaped configuration defined by annular wall 78 in cooperation with a ledge 80 which projects horizontally inwardly from the lower end of the wall, a pair of circumferentially spaced side walls 82, 84 and an inner wall 86 which is joined with the edges of the side walls and ledge. The upper edges 88, 90 of the side walls are horizontal and a generally rectangular shaped opening 92 is formed through the ledge. The handle or shank of a large size tool, for example a hammer, can be inserted down through opening 92 with the head of the tool supported on the horizontal edges of the side walls.

Modular unit 56 is mounted within the bucket to the rim by means of a lip 94 which projects outwardly and downwardly from the upper end of annular wall 78. The lip is formed with an intrusive ridge 96 and cam surface 98 which releasably mount over the bucket rim in the manner described above.

Figure 8:
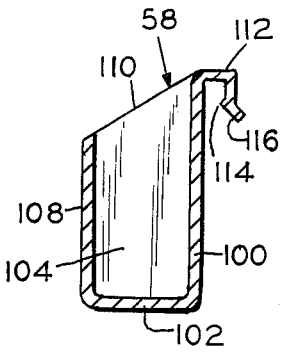
FIG. 8 is a cross-sectional view of another modular unit taken along the line 8—8 of FIG. 5.
Figure 5:
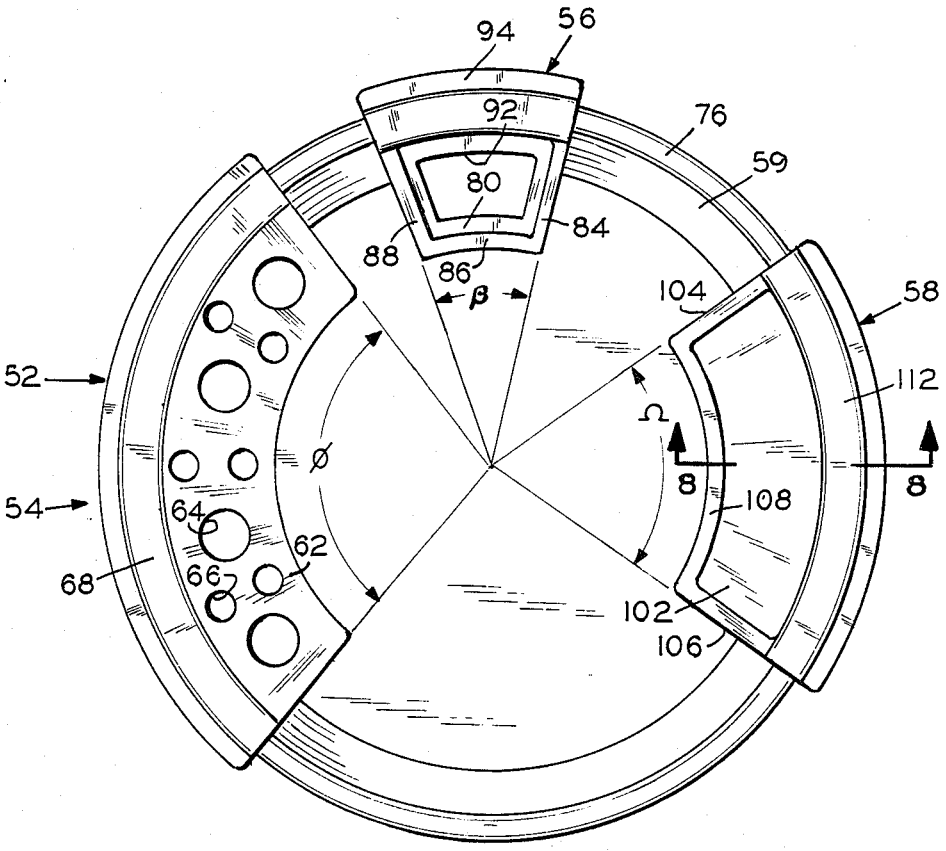
FIG. 5 is a top plan view of another embodiment which provides a tool holder with modular units.

The third modular unit 58 is illustrated in detail in FIG. 8 and is comprised of an annular wall 100 which extends about a partial sector having an angle Ω, shown as 70°. Modular unit 58 is of a box-shaped configuration defined by annular wall 100 in cooperation with a ledge 102 which projects horizontally inwardly from the lower end of wall 100, a pair of spaced apart side walls 104, 106 and an inner wall 108 which is joined with the edges of the side walls and ledge. The upper edges 110 of the side walls incline inwardly and downwardly toward the center of the bucket. Ledge 102 is formed imperforate without openings so as to support different types of tools, implements or equipment which have irregular shapes and sizes not adaptable for fitting within the openings of the other modules. A lip 112 projecting from the upper end of the annular wall has an intrusive ridge 114 and cam surface 116 which releasably mount over the bucket rim in the manner described above.

In the use and operation of the invention the tool holder 10, or any combination of the modular units 54, 56 or 58, are releasably secured to the upper rim of the bucket by resiliently snapping the lip over the bucket's rim. The tool holder or modular units are thereby easily mounted onto the buckets without the requirement of using separate fasteners. The tool holder and modular units can also be easily released and pulled off the buckets when desired. The tool holder can also expand or contract in circumferential size to accommodate buckets of different size diameters so that a single holder can be fitted into different size buckets without the requirement of separate spacers or adapter elements. Different combinations of the modular units 54, 56 or 58 can also be combined and mounted on a single bucket to accommodate a variety of specialized tools and equipment, as required by a particular job.

While the foregoing embodiments are at present considered to be preferred it is understood that numerous variations and modifications may be made therein by those skilled in the art and it is intended to cover in the appended claims all such variations and modifications as fall within the true spirit and scope of the invention.

I claim:

1. A tool holder for use with a can or bucket having a cylindrical wall and bottom wall with the cylindrical wall having an upper rim defining a top opening, the tool holder comprising the combination of an upstanding annular wall extending about a central axis along a partial sector of a circle, said annular wall having an outer diameter substantially commensurate with the cylindrical wall along the margin of the rim portion thereof, a ledge for supporting tools, implements or equipment and the like, said ledge integral with the lower end of the annular wall with the ledge projecting horizontally inwardly, opening means in the ledge forming at least one opening sized sufficiently to releasably hold a tool or other implement, means for releasably mounting the annular wall to the rim of the wall, and said annular wall and ledge being formed of an elastomeric material having a predetermined resiliency which permits the tool holder to flex for expanding and contracting in diameter for fitting of the tool holder into cans and buckets having walls of different diameters.

2. A tool holder as in claim 1 in which the mounting means includes means forming a lip about the upper end of the annular wall with the lip projecting in close-fitting contact about the upper rim of the wall of the can or bucket.

3. A tool holder as in claim 2 in which the lip includes a portion which extends downwardly in spaced-apart relationship about the annular wall to form a channel therewith, said channel having a width which is less than the width of the rim with the resiliency of the elastomeric material permitting the lip to flex outwardly when mounted into engagement about the rim whereby the elastic memory of the lip causes the lip to be releasably secured to the rim.

4. A tool holder as in claim 3 in which the downwardly projecting portion of the lip is formed with an intrusive ridge with the radial width between the ridge and wall defining said channel.

5. A tool holder as in claim 4 in which the rim includes a circumferential bead which projects beyond the outer surface of the cylindrical wall, and the mounting means includes means forming a camming surface on said downwardly extending portion of the lip, said camming surface facing inwardly toward the rim and extending in a direction outwardly and downwardly therefrom whereby mounting of the tool holder onto the bucket causes the rim to act against and flex the camming surface outwardly to permit the intrusive ridge to snap over and releasably engage below the bead.

6. A tool holder as in claim 1 in which the ledge projects radially inwardly from the annular wall at a width which is between one-fifth and one-half of the radius of the cylindrical wall at the plane of the ledge whereby tools, implements and the like may be passed through the space within the interior of the ledge for placement on the bottom wall of the can or bucket.

7. A tool holder as in claim 1 which includes said opening means forming a plurality of openings through the ledge, said opening being selectively sized to releasably hold tools, implements and the like, said openings being arrayed in spaced-apart relationship to each other.

8. A tool holder as in claim 1 which includes a pair of circumferentially spaced-apart side walls extending radially inwardly from said annular wall together with an upright inner wall extending between the inner ends of the side walls, said annular wall, side walls and inner wall cooperating with the ledge to define a box-shaped container for holding one or more of said tools, implements and the like.

9. A tool holder as in claim 8 in which said opening means forming an opening through the ledge for receiving the shank, handle or other part of a tool or implement with the head or another part of such tool or implement being supported by said side wall, inner wall or annular wall.

* * * * *